US005078317A

United States Patent [19]

Kenner et al.

[11] Patent Number: 5,078,317

[45] Date of Patent: Jan. 7, 1992

[54] HEATER FOR MOBILE UNITS

[75] Inventors: Erich Kenner; Peter Reiser; Gerhard Gaysert, all of Esslingen, Fed. Rep. of Germany

[73] Assignee: Eberspächer, Esslingen, Fed. Rep. of Germany

[21] Appl. No.: 483,245

[22] Filed: Feb. 22, 1990

[30] Foreign Application Priority Data

Feb. 23, 1989 [DE] Fed. Rep. of Germany ..... 3905603

[51] Int. Cl.[5] ..... G05D 23/00

[52] U.S. Cl. ..... 237/2 A; 431/12; 431/29

[58] Field of Search ..... 237/2 A, 12.3 C, 12.3 A, 237/12.3 B, 12.3 R; 431/71, 69, 70, 74, 77, 29, 30, 31, 75, 78, 79, 80, 89, 90, 6, 12

[56] References Cited

U.S. PATENT DOCUMENTS 3,221,799 12/1965 Hamelink et al. ..... 431/31

4,439,140 3/1984 Stout ..... 431/30 X

*Primary Examiner*—Henry A. Bennet

*Attorney, Agent, or Firm*—McGlew & Tuttle

[57] ABSTRACT

In space heaters with pressure atomization burners, which have a small combustion chamber volume, good mixing of air with fuel is achieved practically only in the case of relatively high air flow velocities, which leads, however, to difficulties in terms of ignition, especially at high operating voltages and low temperatures. The blower motor is therefore started first when putting the heater into operation, after which it is disconnected from the power source, so that the speed will again decrease, after which the high-voltage ignition and the fuel supply are turned on, so that the ignition can take place at reduced blower speed, and the high-voltage ignition is turned off and the blower motor is restarted after the flame has been recognized in the burner.

14 Claims, 3 Drawing Sheets speed (rpm)
5000
3800
t
$t_0$
$t_1$
$t_2$
$t_3$
turning on of the heater
turning on of the combustion air blower (pre scavenging)
$t_1$
turning off of the combustion air blower
$t_2$
ignition on (high voltage on)
fuel on
$t_3$
ignition off on recognition of flame
turn on blower

HEATER FOR MOBILE UNITS

FIELD AND BACKGROUND OF THE INVENTION

The present invention pertains to a heater for mobile units, e.g., motor vehicles, comprising a burner for liquid fuel, which has a combustion air blower with a motor, a mixing device for producing a fuel-air mixture, an igniting electrode arrangement, and a combustion chamber, and a control device for controlling the ignition process.

Such heaters are usually used as so-called auxiliary or space heaters in passenger cars, trucks, and buses. The liquid fuel (gasoline or diesel fuel) is mixed with combustion air by means of a blower motor and a mixing device, and burned in a combustion chamber. The heat generated in the combustion chamber is removed by means of a heat carrier or heat transfer medium (air or water).

In certain devices, the fuel is atomized by means of a pressure atomizer. The fuel is expelled from the fuel nozzle by means of pressure, and air is admitted by the combustion air blower into the zone of the nozzle in order to thoroughly mix the fuel sprayed out with the air.

Good mixing of the air with the fuel has been known to be a requirement for good combustion. In heaters of the class being discussed here, the combustion chambers are relatively small because the most compact design possible is required, so that the mixing of the air with the fuel must take place within a narrowly limited space. It has now been observed that good mixing of air with the fuel in combustion chambers of small volume can practically be achieved only at relatively high air flow velocities. The combustion air blower therefore operates at a relatively high speed in such a heater.

Even though the high air flow velocity leads to good mixing of the air with the fuel during the operation, it has the disadvantage that ignition becomes difficult, especially at high operating voltages in a cold environment.

To improve the ignition properties of such a heater, one might propose the possibility of providing the blower motor with a protective resistor, which provides for a lower blower motor speed for a certain time period during the ignition phase. Aside from the electrical power loss associated with such an arrangement and the need to dissipate the heat generated in the protective resistor, it is difficult to set a speed suitable for the ignition process because of the inevitable speed tolerance.

One may also consider the possibility of designing an air supply passage such that a lower flow velocity is reached. However, such design solutions are risky, because there is a risk of excessive soot formation, especially at low voltage, because of poor mixing of the air with the fuel.

SUMMARY AND OBJECT OF THE INVENTION

It is an object of the present invention to provide a heater of the class specified in the introduction, in which satisfactory ignition is guaranteed even at high operating voltages and/or low temperatures.

This task is achieved in that in order for the ignition process to take place, the control device turns off the motor while the speed of the combustion air blower motor is below the operating speed and produces ignition by means of the igniting electrode arrangement simultaneously therewith or somewhat later. The present invention is particularly effective and interesting in conjunction with pressure atomization burners with high-voltage ignition.

The heaters are usually operated such that after they are turned on, the combustion air blower is first started in order to "pre-scavenge" the burner. According to the present invention, the combustion air blower is first turned on for this "pre-scavenging", after which it is again turned off, i.e., its voltage is turned off, for a first, predetermined period of time, so that the speed continuously decreases while the blower motor is coming to a stop. The time of ignition after the fuel supply is turned on falls within the phase of continuously decreasing blower speed. What is thus achieved is, first, that the flow velocity and consequently also the amount of air will be low because of the reduced speed of the combustion air blower, as a result of which the fuel-air mixture becomes richer and can be ignited more readily, and, second, that the composition of the mixture changes continuously due to the continuously decreasing speed of the combustion air blower, i.e., at a certain point in time, the composition assumes a state that is optimal for the ignition. At any rate, it is achieved that a mixture that is best suited for ignition is present.

After ignition, the speed of the combustion air blower must again be raised to the value intended for the normal operation by again applying voltage to the blower motor. The point in time of the restart of the blower can be set so that there is a period of time between it and the point in time at which the blower is turned off.

However, based on applicable regulations, the heaters being discussed here have a flame recognition device, which ensures, in conjunction with the control device of the heater, that the ignition process or the operation of the heater is interrupted, and especially the fuel supply is interrupted when no flame is present for a certain period of time. According to the present invention, the signal sent by the flame recognition device is used to restart the combustion air blower after the ignition process. Consequently, the heater is put into operation by first turning on the combustion air blower; its voltage is turned off after a certain period of time, after which the fuel supply is turned on (to do so, a solenoid valve located in the fuel line is opened), an igniting voltage is supplied to the igniting electrodes, and the signal sent by the flame recognition device induces the restart of the combustion air blower.

While the motor of the combustion air blower is turned off and the speed of the blower is decreasing continuously until the blower is restarted after a flame is recognized in order to reduce the air throughput during the starting process in the embodiment explained above, it is also possible—if a speed range for possible ignition is known—to turn off the motor voltage after the combustion air blower motor has been turned on and after its operating voltage for steady-state operation has been reached, and to later turn it on and off intermittently a certain period of time later, so that the fuel supply is started and the ignition is turned on during the intermittent switchings of the blower motor, and that after ignition, voltage is permanently supplied to the blower motor. While the point in time of the ignition falls within a period of continuously decreasing blower speed in one embodiment, intermittent operation of the blower motor in the latter embodiment ensures that the blower operates in a certain range of relatively low speeds. The intermittent switchings on and off are preferably controlled on the basis of two predetermined voltage levels; to achieve this, the electromotive force (EMF) is determined with the blower motor turned off, in which case the blower motor operates as a generator, because it continues rotating due to its own inertia, and this EMF is compared to the two voltage levels. The control devices needed for this purpose are easy to realize with the control devices already present in such heaters. For example, there is a test circuit with which the function of the blower motor is tested after it has been started. To do so, the started motor is briefly turned off, and while it is turned off, the EMF generated by the motor, which now operates as a generator, is measured. Using this device, it is also possible to determine the above-mentioned two voltage levels for controlling the intermittent switchings of the blower motor. In principle, it is also possible to operate with a single reference voltage level to restart the blower motor when a minimum level is reached. The motor is turned on intermittently for predetermined, fixed time periods.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

The present invention pertains especially to a space heater with pressure atomization burner and high-voltage ignition. Such devices are generally known and do not need to be explained in great detail here. In this case, we are concerned especially with the ignition process.

Figure 3:
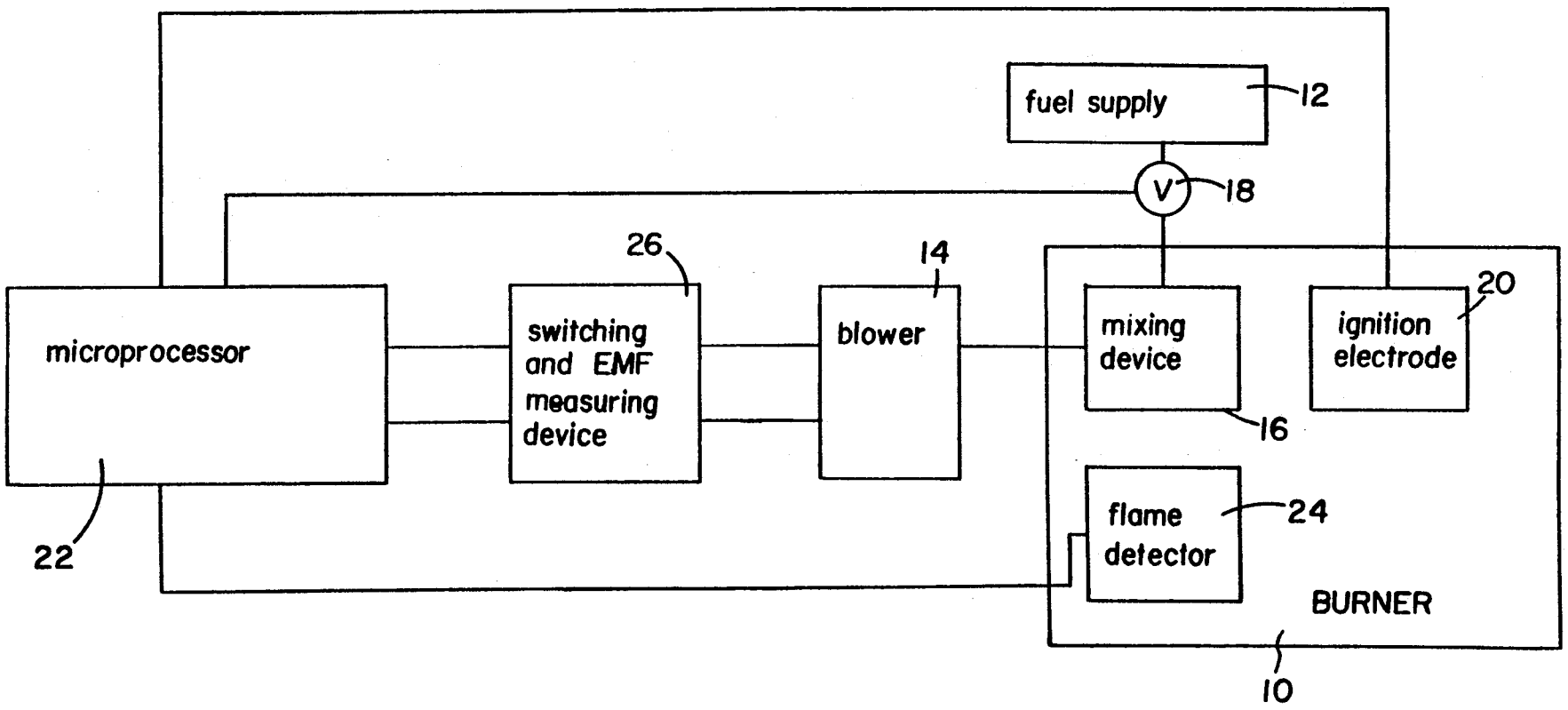
FIG. 3 is a schematic view of the arrangement of the heater of the present invention.

FIG. 3 depicts the overall arrangement of the heater including a burner 10, a fuel supply 12 and a blower 14. A mixing device 16 is provided for mixing liquid fuel with the combustion air. The mixing device 16 may be in the form of a fuel nozzle arrangement atomizer or the like. The fuel supply is connected to the mixing device via a solenoid valve 18. An electrode ignition arrangement 20 is provided for ignition. The operation of the ignition electrode 20, the solenoid valve 18 and the blower 14, are all controlled by a microprocessor or control arrangement 22. A standard flame detector 24 is also provided for sending signals representing the detection of a flame in the burner to the microprocessor 22. The microprocessor 22 and flame detector insure that the ignition process or the operation of the heater is interrupted and especially that the fuel supply is interrupted when no flame is present for a certain period of time. According to the present invention, the signal sent by the flame recognition device 10 is used to re-start the combustion air blower after the ignition process. The microprocessor controls the blower 14 by switching off the voltage supply to the blower. A switching and electromotive force measuring device 26 is provided for switching off the blower in accordance with control signals from microprocessor 22 and/or measuring the voltage or electromotive force produced by the blower. That is, during switch off of the blower while the blower is winding down or the like, the blower acts as a generator. The electromotive force generated by the blower during this generator phase is proportional to the volume rate of flow of air provided by the blower 14.

Figure 1:
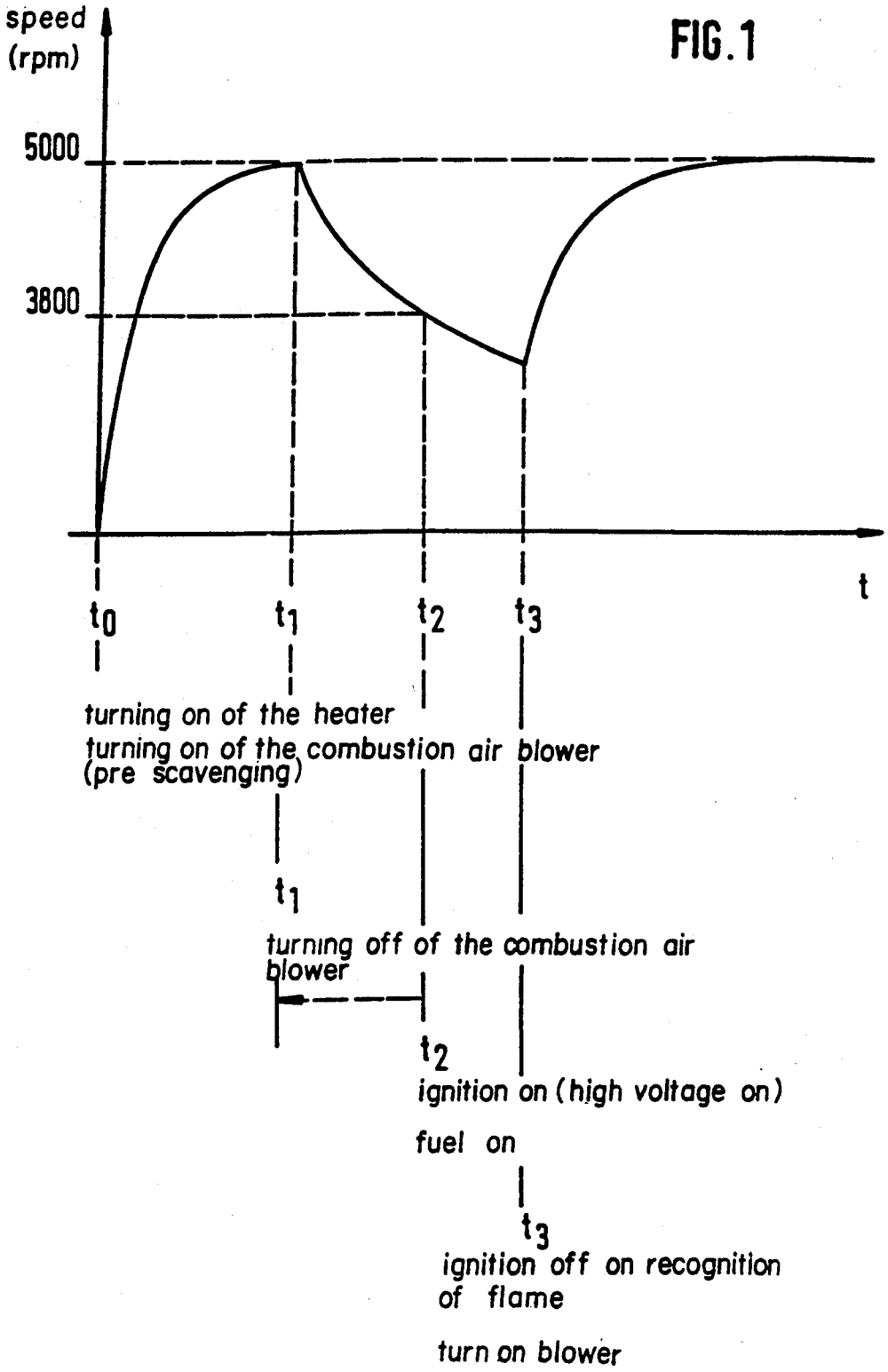
FIG. 1 shows the changes in the speed of a combustion air blower motor for a heater for a motor vehicle as a function of time.

As is shown in FIG. 1, the motor of the combustion air blower is turned on with the turning on of the device, or heater. This is followed by the pre-scavenging phase. It takes a certain time from the time of switching on (to) for the combustion air blower to reach a rated speed of, e.g., 5000 rpm. The voltage of the combustion air blower is turned off at a time $t_1$. The blower continues to rotate at a continuously decreasing speed. Simultaneously with the turning off of the blower (t1) or at a certain time $t_2$ after the turning off of the combustion air blower, the ignition is turned on, and the solenoid valve present in the fuel line is opened, so that fuel is fed to the fuel nozzle. The fuel discharged from the nozzle is mixed with the combustion air arriving from the combustion air blower. Because high voltage is supplied to the igniting electrode, ignition is able to take place. After time $t_2$, the speed of the combustion air blower progressively decreases. The mixture of air and fuel becomes somewhat richer. At any point in time after the time $t_2$, the mixture of air and fuel has the composition and the flow velocity that are suitable for the ignition. Ignition will take place at time $t_3$. The flame now generated is recognized by the flame recognition device. The flame recognition device sends a signal, as a result of which the blower is turned on and the ignition is turned off. The speed of the combustion air blower again rises to the rated value of 5000 rpm, and the heater subsequently operates in the steady state.

As was mentioned, the time interval between $t_2$ and $t_1$ may preferably be zero, but it may also be set to a finite value, depending on the approximately expectable "ignition speed".

The ignition is turned on after the combustion air blower has been turned off, e.g., at a speed of 3800 rpm, and the fuel-air mixture is subsequently ignited at a speed that is even slightly lower than this.

Figure 2:
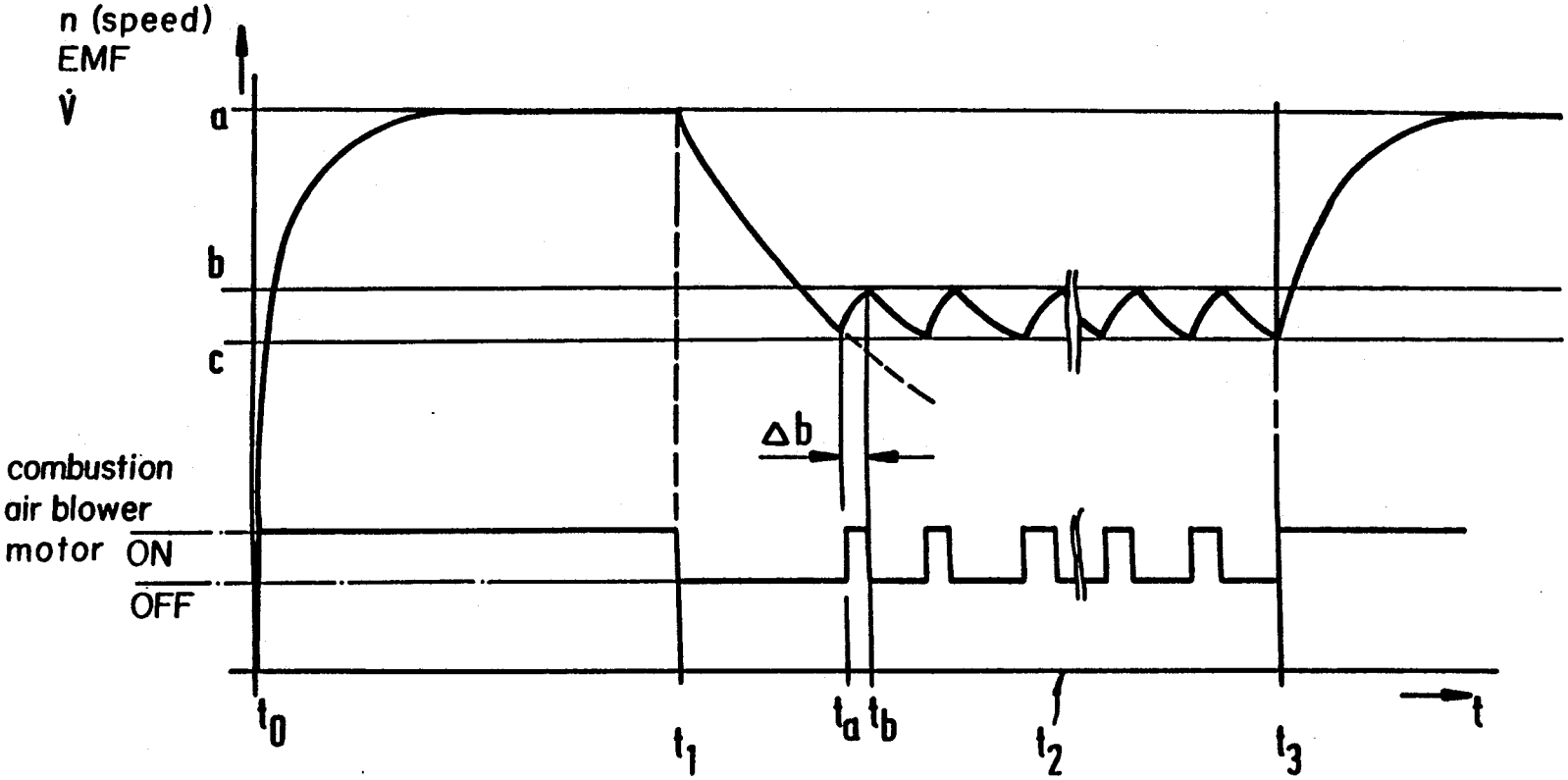
FIG. 2 shows the changes in the speed of a combustion air blower motor according to another embodiment of the present invention as a function of time.

FIG. 2 shows the changes in the speed of the combustion air blower motor in connection with the signals causing the motor to be turned on and off according to another embodiment of the present invention.

After being disconnected from the power source, the combustion air blower motor operates as a generator and generates an EMF which value depends on the actual speed n. The air throughput V is approximately proportional to the speed.

The motor is turned off at time $t_1$, i.e., after the rated speed a for the steady-state operation has been reached. The EMF subsequently generated by the blower motor is determined compared to a lower threshold value c. If the two values compared are equal at time ta, the blower motor is turned on again. A higher threshold value b is reached at time tb, so that the blower motor is again turned off at this time tb. Due to the repeated switchings on and off, the speed of the combustion air blower varies between the two values c and b. The fuel supply is started and the igniting electrodes are turned on during this phase of intermittent turnings on and off.

The flame is recognized at time t3 and voltage is again supplied continuously to the blower motor.

Setting of the speed or the EMF according to level b may be omitted, and the "on" period delta b, during which the blower motor is briefly turned on, can be set, instead. Based on empirical values, the value delta b can be set so that a speed that is approximately equal to the value b will be reached after this period.

While a specific embodiment of the invention has been shown and described in detail to illustrate the application of the principles of the invention, it will be understood that the invention may be embodied otherwise without departing from such principles.

What is claimed is:

1. A heater for mobile units, comprising: a liquid fuel burner; a combustion air blower with a motor; liquid fuel supply connected to a mixing device for generating the fuel-air mixture; combustion chamber including an igniting electrode arrangement; and, control means for controlling the ignition process, said control means connected to said air blower and connected to said mixing device for shutting off electric power to said blower motor and simultaneously or shortly thereafter causing ignition by said igniting electrode arrangement to start the ignition process while the speed of revolution of the combustion air blower is below the operating speed and above a speed of no revolution.

2. A heater according to claim 1, wherein said burner is a pressure atomization burner, said igniting electrode provides high-voltage ignition.

3. A heater according to claim 1, wherein said control means put the heater into operation by first turning said blower motor on, subsequently turning off a voltage supply to the combustion air blower motor after expiration of a first, predetermined time period; applying voltage to said igniting electrode to perform ignition simultaneously with turning off the voltage supply to said combustion air blower motor or after a predetermined time period after turning off the voltage to said blower motor, said ignition occurring simultaneously with or after the beginning of the fuel supply; and subsequently applying voltage to said combustion-air blower after ignition has taken place.

4. A heater according to claim 3, wherein said control means is connected to a flame recognition device, upon flame recognition, said combustion air blower motor being re-started automatically.

5. A heater according to claim 1, wherein said blower motor is turned off only after a steady state operation operating speed has been attained, subsequently said combustion air blower motor is turned on and turned off intermittently of a fuel supply and the ignition being turned during the intermittent switching of the combustion air blower motor, subsequent to ignition, the voltage being again permanently supplied to the combustion air blower motor.

6. A heater according to claim 5, wherein said intermittent turning on and turning off of said combustion air blower motor is controlled based on the sensed electromotive force sensed when the combustion air or motor is turned off, thereby operating as a generator, since the electromotive force being compared to predetermined voltage levels.

7. A method for operating a heater for mobile units having a burner for liquid fuel, a combustion air blower with a motor, a mixing device for producing an air-fuel mixture, an igniting electrode device, a combustion chamber, and a control device for controlling the ignition, the method comprising the steps of:

turning off the air blower motor;

allowing the motor to slow down but not stop; igniting the air-fuel mixture.

8. A method according to claim 7, wherein said step of igniting the air-fuel mixture follows said step of turning off the air blower motor by a predetermined amount of time.

9. A method according to claim 7 wherein said method of turning off the air blower motor and said step of igniting the air-fuel mixture are conducted simultaneously.

10. A method according to claim 7, wherein after said step of turning off the air blower motor and before said step of igniting the fuel-air mixture allowing the motor to reach a predetermined speed; switching the motor on and off intermittently thereby keeping the speed of the motor within a predetermined range which is slower than the speed of the motor before said step of turning the motor off and above a speed of no revolution.

11. A method according to claim 10, further comprising the steps of allowing the blower motor to operate as a generator when the blower motor is turned off; measuring the EMF of the blower motor; establishing 2 separate voltage levels both of which being lower the voltage level measured substantially immediately after said step of turning off the air blower motor; keeping the voltage level of the blower motor between the two established levels thereby accomplishing said step of keeping the speed of the motor in a predetermined range.

12. A method for operating a heater for mobile units having a burner for liquid fuel, a combustion air blower with a motor, a mixing device for producing an air-fuel mixture, an igniting electrode device, a combustion chamber, and a control device for controlling the ignition, the method comprising the steps of:

starting the heater; switching on the air blower motor; idling the air blower motor after a first predetermined time after said step of starting up the heater; supplying the fuel to the combustion chamber; igniting the air-fuel mixture; repeating said step of switching on the air blower motor.

13. A method according to claim 12 wherein said steps of idling the air blower motor and igniting the air-fuel mixture are performed simultaneously.

14. A method according to claim 12 wherein said step of igniting the air-fuel mixture is performed after said step of idling the air blower motor.

* * * * *